US006133683A

United States Patent [19]

Enomoto et al.

[11] Patent Number: 6,133,683

[45] Date of Patent: Oct. 17, 2000

[54] COLOR CATHODE RAY TUBE HAVING AN INTERNAL VOLTAGE DIVIDER

[75] Inventors: Tetsuya Enomoto, Tougane; Hidemasa Komoro, Chousei-gun; Shoji Shirai, Mobara, all of Japan

[73] Assignees: Hitachi, Ltd., Tokyo; Hitachi Device Engineering Co., Ltd., Chiba-ken, both of Japan

[21] Appl. No.: 09/098,740

[22] Filed: Jun. 17, 1998

[30] Foreign Application Priority Data

Jun. 17, 1997 [JP] Japan ..... 9-159498

[51] Int. Cl.[7] ..... H01J 29/50

[52] U.S. Cl. ..... 313/414; 313/412; 313/457; 315/3

[58] Field of Search ..... 313/414, 412, 313/457, 456, 3, 368.15, 382.1

[56] References Cited

U.S. PATENT DOCUMENTS 5,077,497 12/1991 Kamohara et al. ..... 315/3

FOREIGN PATENT DOCUMENTS 61-71535 4/1986 Japan .
61-147443 7/1986 Japan .
61-183851 8/1986 Japan .
63-13242 1/1988 Japan .
7211246 8/1995 Japan .
7211256 8/1995 Japan .
9204881 8/1997 Japan .

*Primary Examiner*—Vip Patel
*Assistant Examiner*—Karabi Guharay
*Attorney, Agent, or Firm*—Antonelli, Terry, Stout & Kraus, LLP

[57] ABSTRACT

A color cathode ray tube includes an evacuated envelope having a panel portion with a phosphor screen formed on an inner surface thereof, a neck portion, and a funnel portion connecting the panel portion and the neck portion, and an electron gun housed in the neck portion. The electron gun has a cathode and a plurality of focus grid electrodes including grid electrodes for forming a multistage focus lens for focusing an electron beam emitted from the cathode. The cathode and the focus grid electrodes are fixed in predetermined axially spaced relationship by a pair of bead glass. The electron gun is provided with a voltage divider for producing at least one voltage other than a voltage supplied from outside the evacuated envelope, the voltage divider is made of at least one resistor and is fabricated as a separate element from the bead glass, and at least one of bead glass is provided with a recess for receiving the voltage divider in a surface thereof on a side thereof facing away from the cathode and the focus grid electrodes.

8 Claims, 10 Drawing Sheets

COLOR CATHODE RAY TUBE HAVING AN INTERNAL VOLTAGE DIVIDER

BACKGROUND OF THE INVENTION

The present invention relates to a cathode ray tube, in particular to a color cathode ray tube having an electron gun employing a multistage focus lens.

Color cathode ray tubes, which are used as TV picture tubes, or monitor tubes in information terminals, house an electron gun for emitting a plurality (usually three) of electron beams at one end of an evacuated envelope, a phosphor screen formed of phosphors coated on an inner surface of the evacuated envelope at the other end thereof for emitting light of a plurality (usually three) of colors, and a shadow mask which serves as a color selection electrode and is closely spaced from the phosphor screen. The electron beams emitted from the electron gun are deflected to scan the phosphor screen two-dimensionally by magnetic fields generated by a deflection yoke mounted externally of the evacuated envelope and display a desired image on the phosphor screen.

FIG. 8 shows a cross-sectional view for explaining an example of the constitution of a color cathode ray tube, and in FIG. 8, reference numeral 1 denotes a panel portion, 1*a* denotes a screen, 2 denotes a neck portion for housing an electron gun, 3 denotes a funnel portion for connecting the panel portion and the neck portion, 4 denotes a phosphor screen, 5 denotes a shadow mask, 6 denotes a mask frame, 7 denotes a magnetic shield, 8 denotes a mask suspension mechanism, 9 denotes an in-line type electron gun, 10 denotes a deflection yoke, 11 denotes an internal conductive coating, 12 denotes a shield cup, 13 denotes a contact spring, 14 denotes a getter and 15 denotes stem pins.

In the case of the color cathode ray tube, the evacuated envelope is composed of the panel portion 1, the neck portion 2 and the funnel portion 3, and electron beams B emitted from the electron gun 9 housed in the neck portion 2 scan the phosphor screen 4 two-dimensionally under the horizontal and vertical deflection magnetic fields produced by the deflection yoke 10.

The electron beams B are modulated in amount by modulating signals such as video signals supplied via the stem pins 15, are color-selected by the shadow mask 5 disposed immediately in front of the phosphor screen 4, and impinge upon the phosphors of the corresponding colors to reproduce a desired image.

The cathode ray tubes of this kind are provided with a multistage focus lens in the electron gun and a dynamic focusing system is widely adopted where at least one of the electrodes constituting the multistage focus lens is supplied with a voltage varying dynamically, to obtain sufficiently small beam spots over the entire phosphor screen.

FIG. 9 is a schematic for explaining one type of an electron gun employing a dynamic focusing system which is proposed in the Japanese Patent Laid-open Publication No. Hei 8-102265, and in the FIG. 9, reference character H denotes a heater and K denotes a cathode. The first grid electrode G1 and the second grid electrode G2 form electrons generated by the cathode K into a beam and the beam is projected onto the phosphor screen being focused and accelerated by the third grid electrode G3, the fourth grid electrode G4, the fifth grid electrode G5, the sixth grid electrode G6 and the seventh grid electrode (anode) G7. Z—Z shows the direction of the tube axis.

In the case of an electron gun of this type, the sixth grid electrode G6 and the seventh grid electrode G7 form a main lens. The anode voltage Eb, the highest voltage, is applied to the seventh grid electrode G7, and a pre-main focus lens is formed by the third grid electrode G3, the fourth grid electrode G4, the fifth grid electrode G5 and the sixth grid electrode G6, and a fixed voltage $VG_2$ is applied to the fourth grid electrode G4, and a focus voltage of a fixed voltage Vf superimposed with a dynamic voltage Vd is applied to the third grid electrode G3 and the sixth grid electrode G6. The fifth grid electrode G5 is connected to the sixth grid electrode G6 with a resistor 25 incorporated within the cathode ray tube.

The fifth grid electrode G5 is supplied with the fixed voltage Vf superimposed with the dynamic voltage Vd voltage-divided by a combination of the resistor 25, a capacitance Ca between the fifth and the sixth grid electrodes G5 and G6, and a capacitance Cb between the fourth and the fifth grid electrodes G4 and G5.

FIG. 10 is a schematic for explaining an electron gun of another type employing the dynamic focus system which is proposed in the Japanese Patent Laid-open Publication No. Hei 8-102265, and the same reference numerals as utilized in FIG. 9 designate corresponding portions in FIG. 10.

In the case of the electron gun of this type, a pre-main focus lens is composed of the electrodes, from the third grid electrode G3 to the sixth grid electrode G6, and a fixed voltage $VG_2$ is applied to the fourth grid electrode G4 and the dynamic focus voltage Vd is applied to the third grid electrode G3 and the sixth grid electrode G6.

The fifth and the sixth grid electrodes G5 and G6 are connected with each other by the resistor 25 within the tube, the sixth and the seventh grid electrodes G6 and G7 are connected with each other by the resistor 26 within the tube, and the sixth grid electrode G6 is grounded via the variable resistor Rex external to the tube.

The sixth grid electrode G6 is supplied with the anode voltage Eb voltage-divided by a combination of the resistors 26 and Rex. The fifth grid electrode G5 is supplied with the voltage applied to the sixth grid electrode G6 superposed with the dynamic voltage Vd voltage-divided by a combination of the resistor 25, a capacitance Ca between the fifth and sixth grid electrodes G5 and G6 and a capacitance Cb between the fourth and fifth grid electrodes G4 and G5.

As shown in FIG. 9 and FIG. 10, in the case of a dynamic focus type electron gun, a plurality of voltages are required for the pre-main focus electrodes. It is difficult to supply these voltages through the stem pins in view of standardization, withstand voltage characteristics and others of the stems, so that a plurality of voltages are produced with the resistors incorporated within the evacuated envelope.

In order to produce a plurality of different voltages within a cathode ray tube, it was proposed that voltage-dividing resistors are mounted on the back of the bead glass, that is, the surface on the side of the bead glass facing away from the cathodes and grid electrodes as disclosed in Japanese Patent Laid-Open Publication Hei 7-211256, and that a high-resistance material is embedded in a groove formed in the bead glass and is tapped at proper positions thereof to provide desired resistors.

However, in the case where resistors are fixed on the back of the bead glass, it is necessary to make the bead glass thinner to secure the spacing between the resistors and the inner wall of the glass neck portion 2.

FIGS. 11A and 11B are illustrative drawings for explaining an example of the constitution of a beaded electrode assembly of a conventional electron gun in which resistor elements are fixed on the back of the bead glass. FIG. 11A shows the side view of the beaded electrode assembly and FIG. 11B shows the front view of the bead glass of the same.

As shown in FIGS. 11A and 11B, the cathode K, the first grid electrode GI, the second grid electrode G2, the third grid electrode G3, the fourth grid electrode G4, the fifth grid electrode G5, the sixth grid electrode G6 and the seventh grid electrode G7 of the electron gun are fixed in the predetermined order by embedding peripheral flanges of the grid electrodes or support tabs attached thereto in a pair of bead glass 23.

Necessary spacing for suppressing the occurrence of arcing and the like is provided between the bead glass 23 and the inner wall of the neck portion 2.

In the case of an electron gun of this type, when a resistor element 25 or 26 is fixed on the back of the bead glass 23 as it is, the resistor element becomes too close to the inner wall of the neck portion 2.

In order to avoid that, it is necessary to decease the thickness of the bead glass 23. However, when the bead glass 23 is made thinner, peripheral flanges of the grid electrodes or support tabs attached thereto cannot be embedded sufficiently deep into the bead glass 23, which injures sufficient support of electrodes. It may cause such problems as to increase the noises due to the vibration of the electrodes caused by external forces on a cathode ray tube or to develop cracks in the bead glass. In the case of a cathode ray tube in which a resistor is formed by embedding a high-resistivity material in a groove provided on the bead glass, there have been problems as mentioned below. Unlike the resistor elements fabricated as separate elements from the bead glass, it is difficult to obtain accurate values of resistance, and also it requires difficult work to dispose the high-resistivity material uniformly in the groove, which naturally increases the manufacturing cost and makes the mass production difficult.

SUMMARY OF THE INVENTION

An object of the present invention is to provide a color cathode ray tube having an electron gun which has eliminated the problems of the prior art, and facilitated the mounting of resistors on the bead glass without decreasing the strength of the bead glass, thereby suppressing the increase in cost.

In order to achieve the above-mentioned object, in the present invention, a recess in which resistor elements are to be incorporated is provided on the back of the bead glass which enabled to secure the spacing between the inner wall of the neck portion and the resistor elements.

In a cathode ray tube according to the present invention, an evacuated envelope is composed of the panel portion, the neck portion and the funnel portion, a phosphor screen is formed in the panel portion, and an electron gun is housed in the neck portion, the electron gun comprises at least one cathode and a plurality of grid electrodes including focus electrodes for forming a multistage focus lens for focusing the electron beams emitted from the cathode disposed in the axial direction and fixed with bead glass. The cathode ray tube is provided with a recess in the back of the bead glass, which is the surface on the side of the bead glass facing away from the cathodes and grid electrodes, and is provided with a resistor element in the recess for producing a plurality of focus voltages for forming the multistage focus lens.

It is desirable to form the recess in a part where the thickness of the bead glass is comparatively large, and it is also desirable to form the recess to conform to the external shape of the resistor element to be incorporated therein.

It is possible to fix resistors in the recess by fitting them snugly in the recess or by using an adhesive, after the peripheral flanges of the grid electrodes or support tabs attached thereto are embedded in the bead glass, or during the operation of embedding the grid electrodes in the heat-softened bead glass, the resistor element can also be embedded in the heat-softened bead glass if the resistance element is placed to be in contact with the heat-softened bead glass on the beading jig for supporting the back of the heat-softened bead glass.

Further, the recess formed in the bead glass can be shaped such that the recess has walls having a contour defining a rectangular slot, the recess is a groove extending axially, or the recess is in a form of a thinned-down area.

As described in the above, the present invention makes it possible to produce necessary focus voltages without reducing the spacing between the bead glass and the inner wall of the neck portion and also without deteriorating the strength and the rigidity of the beaded electrode assembly.

BRIEF DESCRIPTION OF THE DRAWINGS

The drawings form an integral part of the specification and are to be read in conjunction therewith, in which like reference numerals designate similar components throughout the figures, and in which.

DETAILED DESCRIPTION OF THE PREFERRED EMBODIMENTS

Figure 1A:
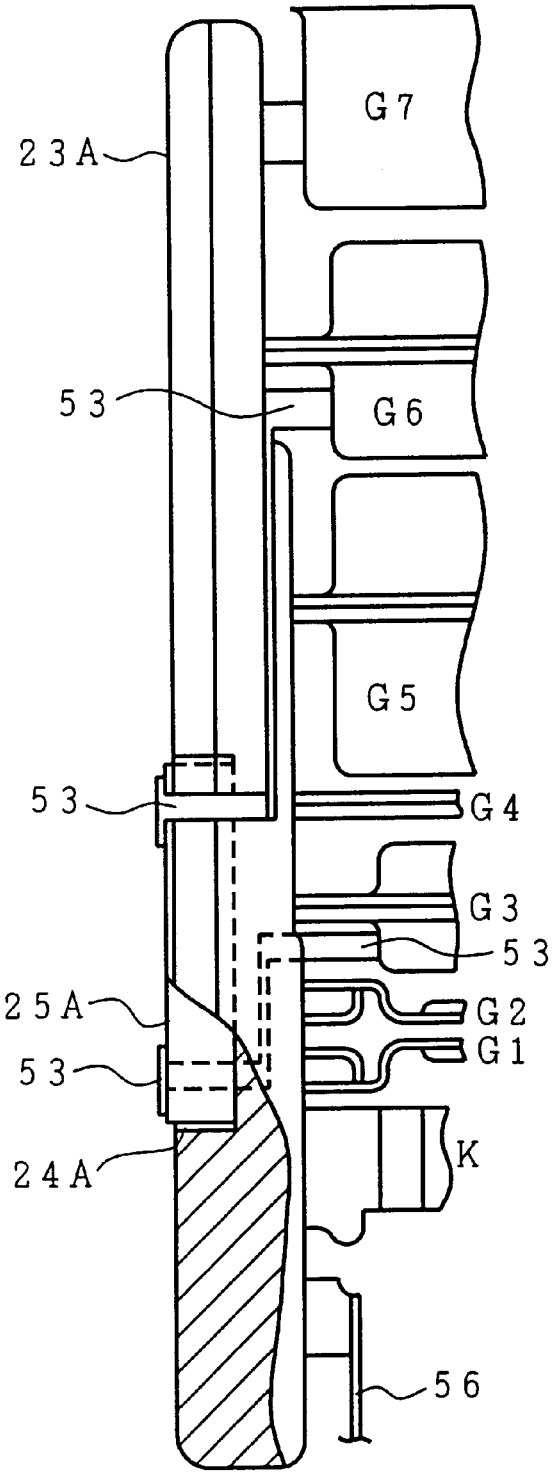
FIGS. 1A and 1B show the primary part of an electron gun for explaining a first embodiment of a color cathode ray tube according to the present invention, and FIG. 1A showing a partially cut-away side view thereof and FIG. 1B showing a front view thereof.

The detailed explanation will be given to the embodiments according to the present invention referring to the drawings.

Figure 1B:
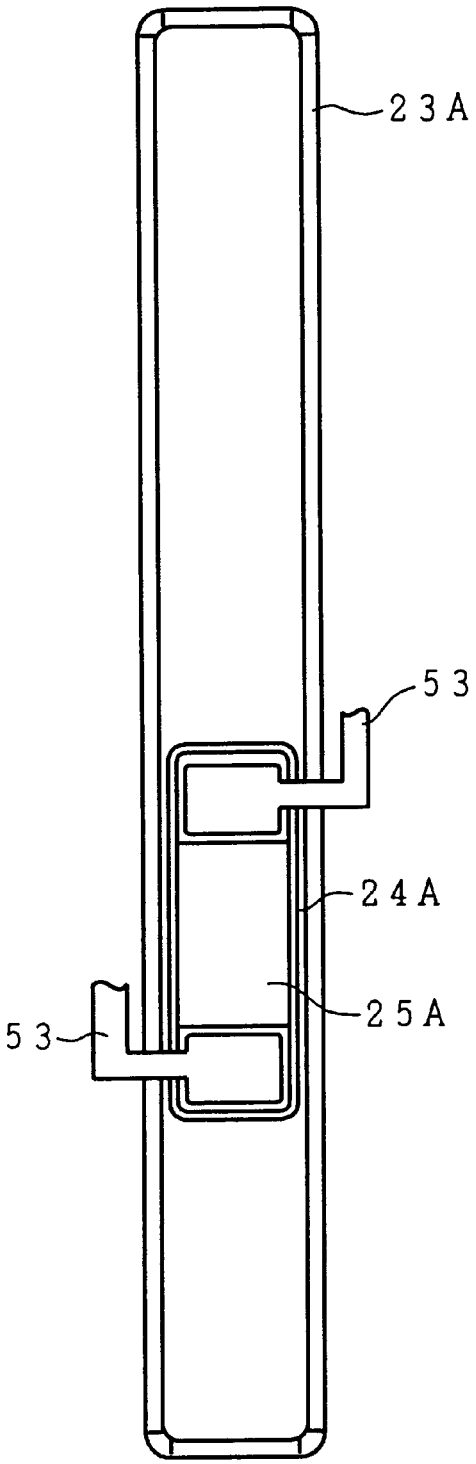
Figure 11A:
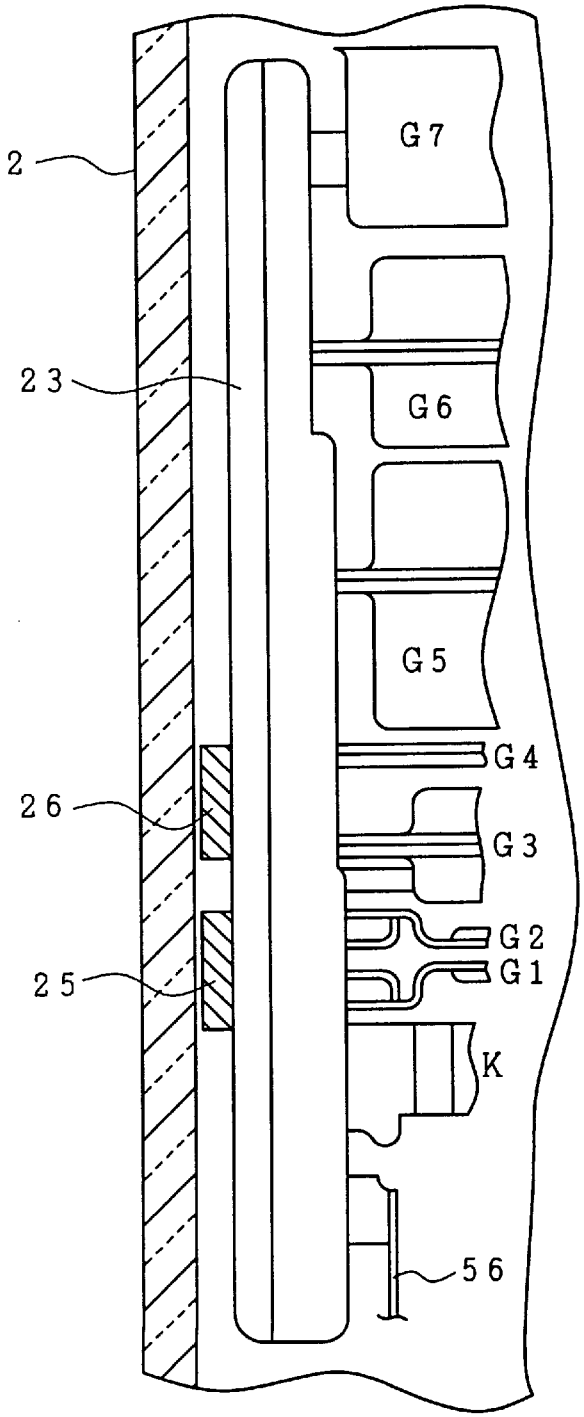
FIG. 11A (PRIOR ART)
FIGS. 11A and 11B show an example of the constitution of a beaded electrode assembly of a conventional electron gun with resistor elements fixed on the back of a bead glass, and FIG. 11A showing a side view of the beaded electrode assembly and FIG. 11B showing a front view thereof.
Figure 11B:
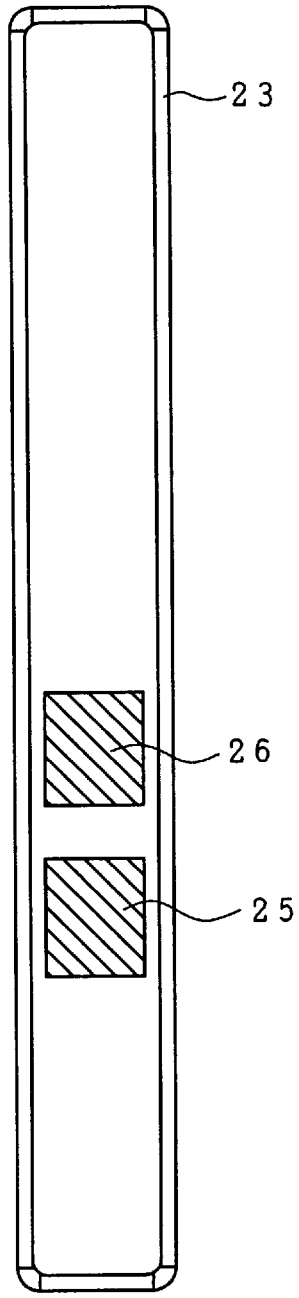
FIG. 11B (PRIOR ART)

FIGS. 1A and 1B show a constitution of an electron gun for explaining a first embodiment of a color cathode ray tube according to the present invention, and FIG. 1A shows a partially cut-away side view thereof and FIG. 1B shows a front view thereof. The same reference numerals as utilized in FIGS. 11A and 11B designate corresponding portions in FIGS. 1A and 1B.

In the present embodiment, the cathode K, the first grid electrode G1, the second grid electrode G2, the third grid electrode G3, the fourth grid electrode G4, the fifth grid electrode G5, the sixth grid electrode G6 and the seventh grid electrode G7 are fixed on the bead glass 23A in the predetermined order by embedding the peripheral flanges of the grid electrodes or the support tabs attached thereto in a pair of the bead glass 23A.

Figure 6A:
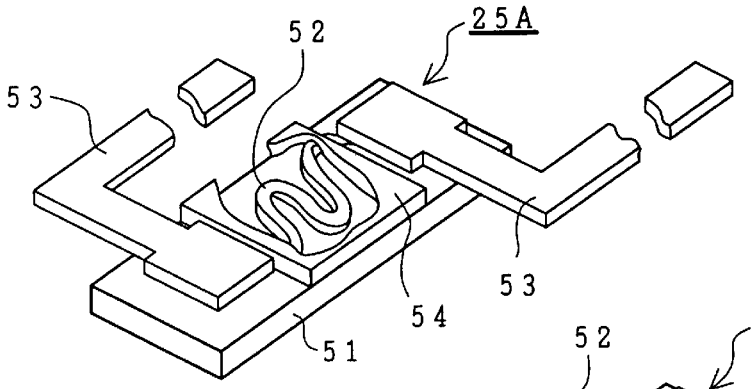
FIGS. 6A, 6B and 6C show partially cut-away perspective views showing different examples of resistor elements according to the present invention respectively.
Figure 7A:
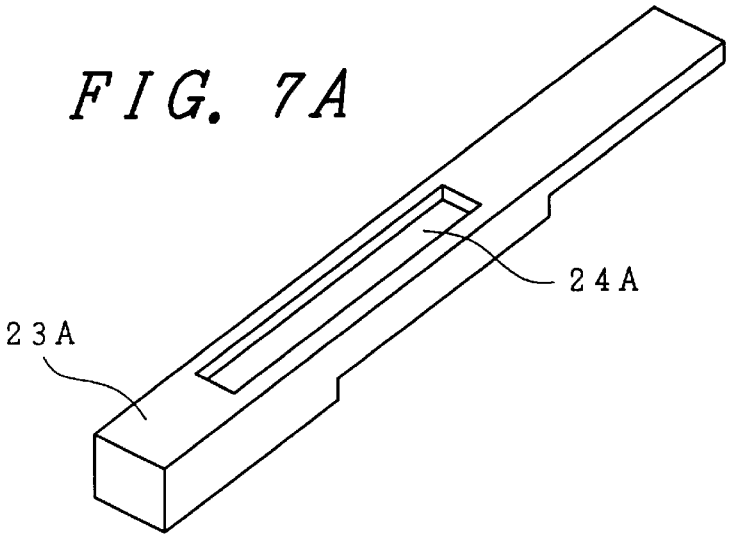
FIGS. 7A, 7B and 7C show perspective views showing the different examples of bead glass according to the present invention respectively.

A perspective view of the bead glass 23A is shown in FIG. 7A. The thickness and the shape of the bead glass 23A are approximately equal to those of a conventional bead glass (refer to the bead glass 23 shown in FIGS. 11A and 11B), and the required spacing is secured between the bead glass 23A and the inner surface of the neck portion 2. In a part of the bead glass 23A, there is formed a recess 24A having walls of a contour defining a rectangular slot, and a resistor element 25A is fitted therein. FIG. 6A shows a perspective view of the resistor element 25A, and as shown in FIG. 6A, a resistive film 52 made from, for example, ruthenium oxide is coated on a insulating substrate 51 made of ceramic, or the like. The contacting tabs 53 are provided at both ends of the resistive film 52, and the resistive film 52 is overcoated with a glass layer 54. The resistor element 25A is fixed in the recess 24A by fitting snugly. The resistor element 25A can be held in place by press-fitting or friction clamping, and it is also good to fix it with a proper (free from outgassing) adhesive applied onto the bottom surface of the resistor element 25A. In FIG. 1A, however, the resistor element 25A is connected electrically to the grid electrodes and also is fixed physically to the grid electrodes, only by welding one of the connecting tabs 53 of the resistor element 25A to the sixth grid electrode G6 and the other to the third grid electrode G3.

According to the present embodiment, it is possible to obtain an electron gun having resistors for producing necessary focus voltages without reducing the spacing between the bead glass 23A and the inner wall of the neck portion and also without decreasing the strength and rigidity of the beaded electrode assembly; thereby it is possible to obtain a color cathode ray tube which provides good resolution over the entire screen.

Figure 2A:
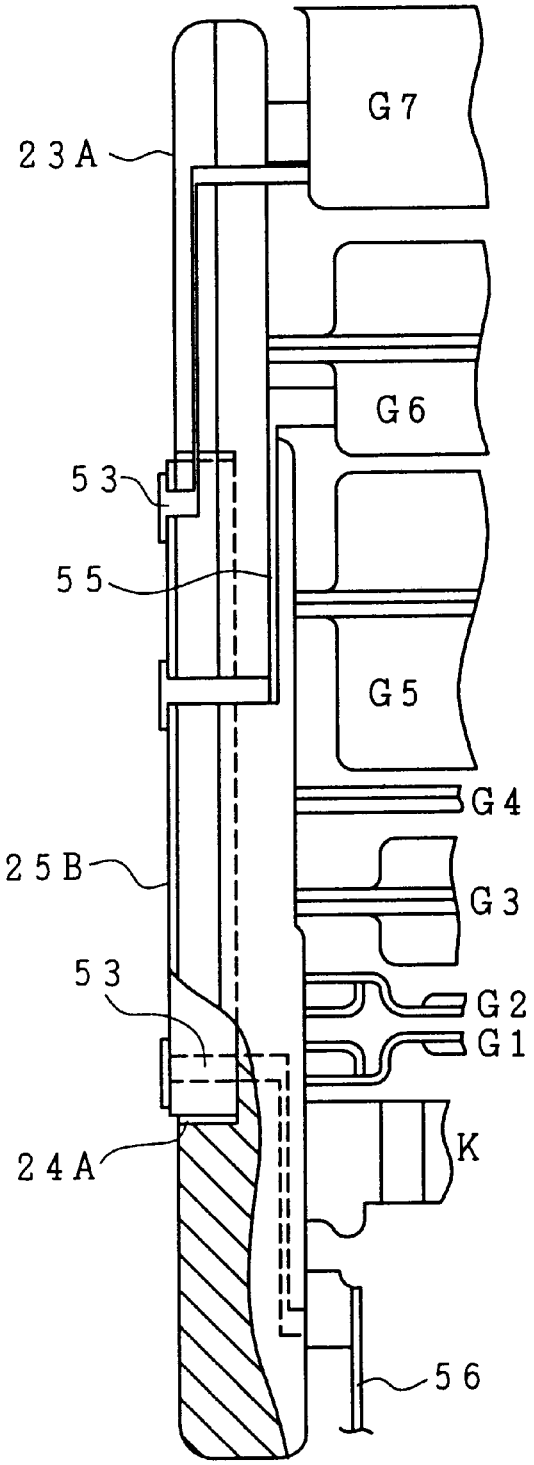
FIGS. 2A and 2B show the primary part of an electron gun for explaining a second embodiment of a color cathode ray tube according to the present invention, and FIG. 2A showing a partially cut-away side view thereof and FIG. 2B showing a front view thereof.
Figure 2B:
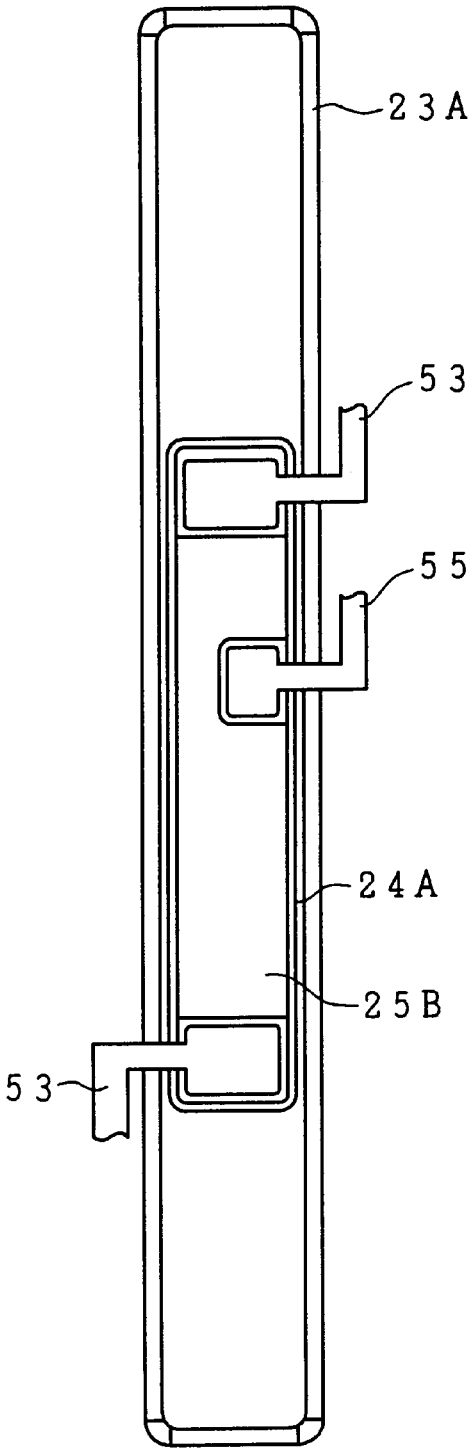

FIGS. 2A and 2B show a primary part of an electron gun for explaining a second embodiment of a color cathode ray tube according to the present invention, and FIG. 2A shows a partially cut-away side view of the beaded electrode assembly and FIG. 2B shows a front view of it. The same reference numerals as utilized in FIGS. 1A and 1B designate corresponding portions in FIGS. 2A and 2B.

In the present embodiment, the cathode K, the first grid electrode G1, the second grid electrode G2, the third grid electrode G3, the fourth grid electrode G4, the fifth grid electrode G5, the sixth grid electrode G6 and the seventh grid electrode G7 are fixed in the predetermined order by embedding the peripheral flanges of the grid electrodes or the support tabs attached thereto in a pair of bead glass 23A.

Figure 8:
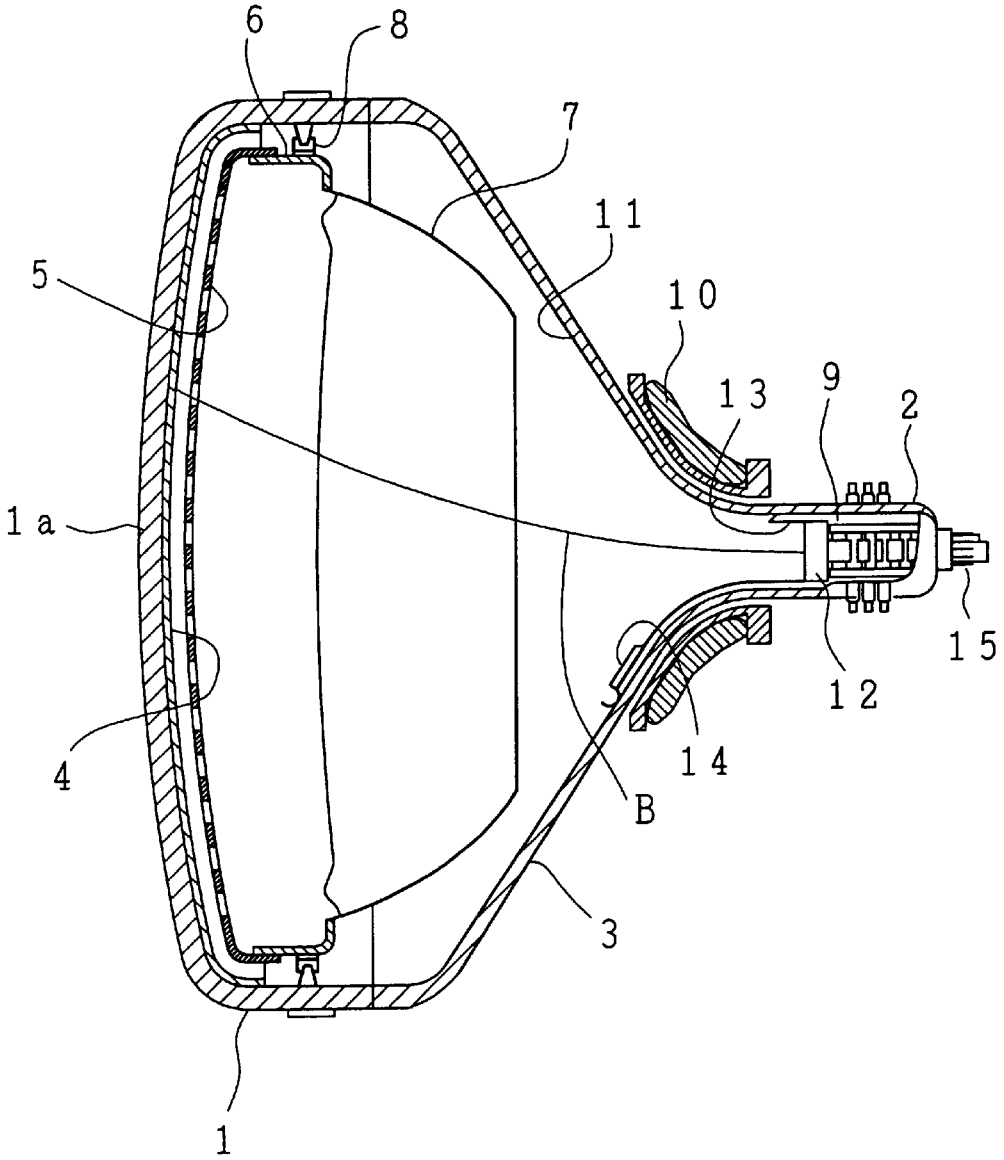
FIG. 8 (PRIOR ART)
FIG. 8 shows a cross-sectional view for explaining an example of the constitution of a color cathode ray tube.
Figure 9:
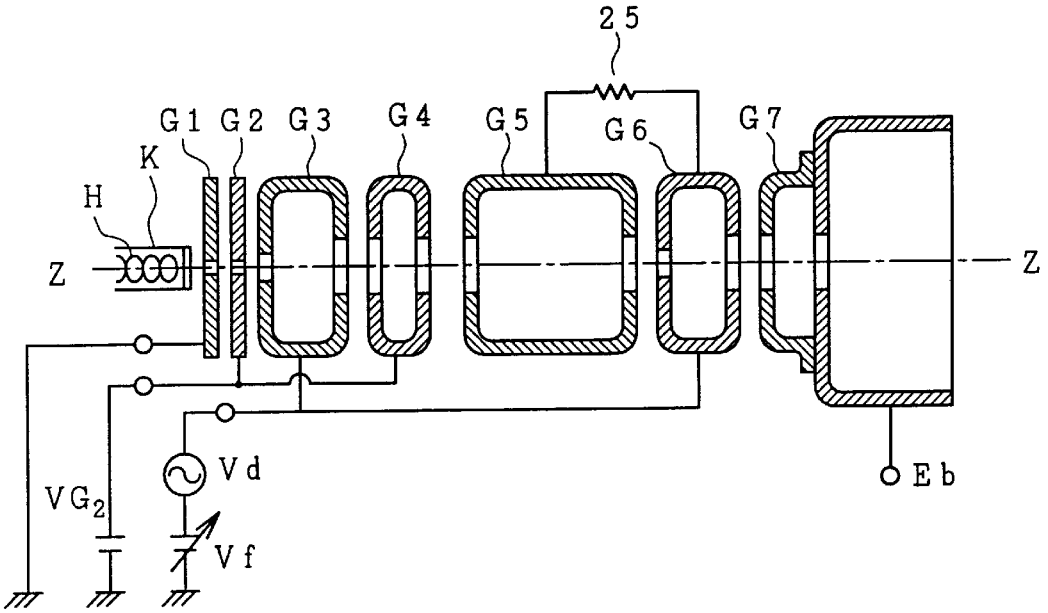
FIG. 9 (PRIOR ART)
FIG. 9 is a schematic for explaining a type of an electron gun employing the dynamic focus system.
Figure 10:
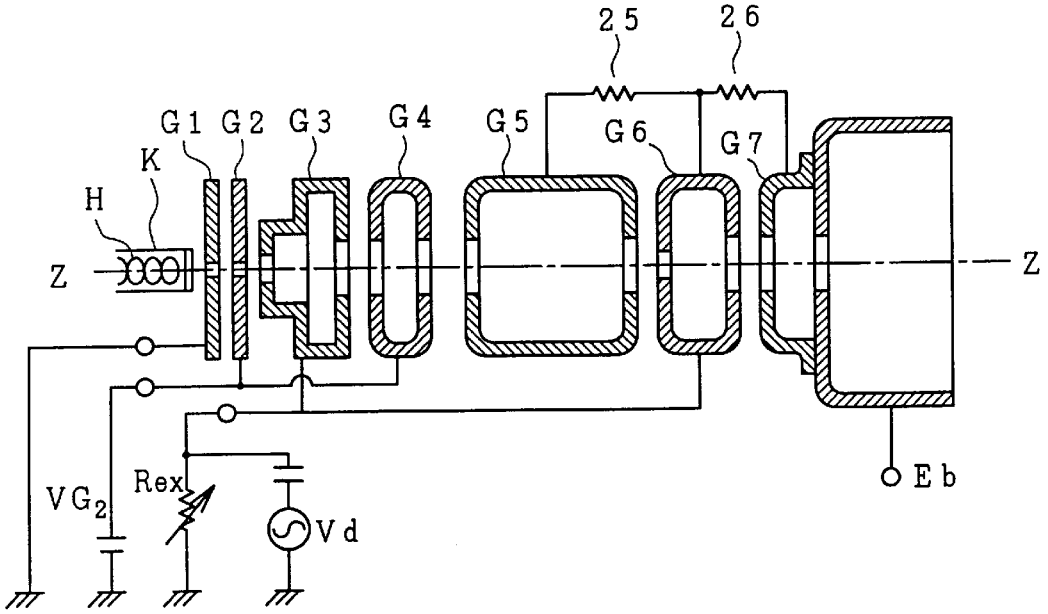
FIG. 10 (PRIOR ART)
FIG. 10 shows a schematic for explaining another type of an electron gun employing the dynamic focus system.

The bead glass 23A is shown in FIG. 7A, and the thickness and the shape of it are the same as those shown in FIGS. 1A and 1B. The necessary spacing between the bead glass 23A and the inner wall of the neck portion 2 (refer to FIG. 8) is secured.

A recess 24A is formed in the back of the bead glass 23A, and the recess 24A has walls of a contour defining a rectangular slot, and a resistor element 25B is fitted therein.

Figure 6B:
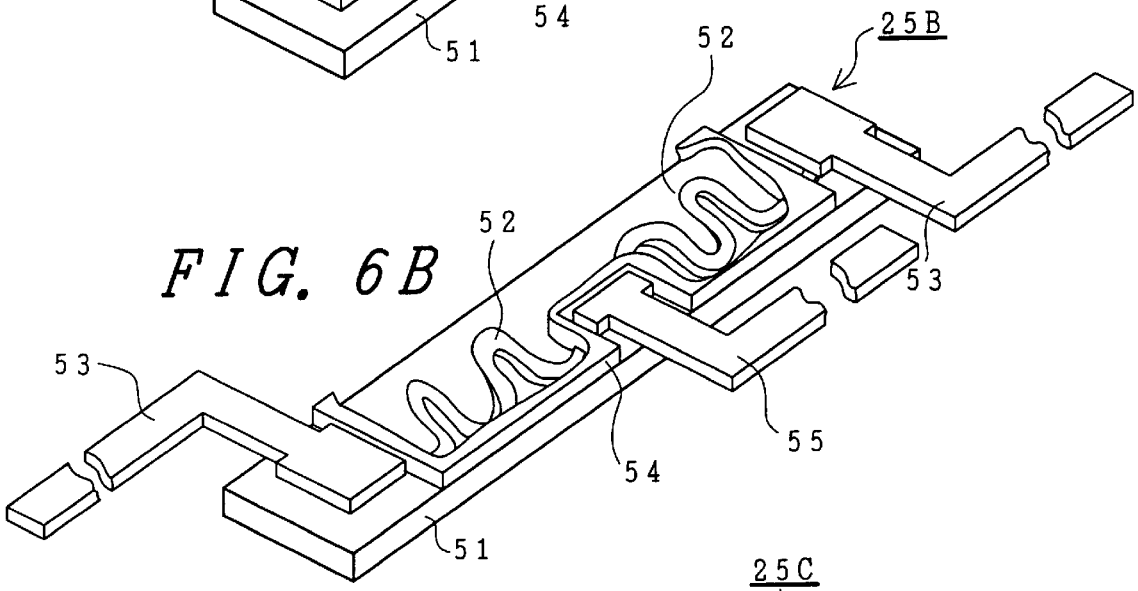

FIG. 6B shows a perspective view of the resistor element 25B, and a resistive film 52 made of, for example, ruthenium oxide is coated on an insulating substrate 51 made of ceramic, or the like. Connecting tabs 53 are fixed at both ends of the resistive film 52, and further, a tap 55 is provided at the midpoint of the resistive film 52. The resistive film 52 is overcoated by a glass layer 54.

The resistor element 25B is fixed in the recess 24A by fitting snugly. The resistor element 25B can be held in place by press-fitting or friction clamping, and it is also good to fix it with a proper (free from outgassing) adhesive applied onto the bottom surface of the resistor element 25B.

In FIG. 2A, however, the resistor element 25B is connected electrically to the grid electrodes and also is fixed physically to the grid electrodes, only by welding one of the connecting tabs 53 of the resistor element 25B to the seventh grid electrode G7 ,the other to a connector 56 which supports the beaded electrode assembly, and the tap 55 to the sixth grid electrode G6. The connector 56 is connected to the stem pin 15 (refer to FIG. 8).

According to the present embodiment, it is possible to obtain an electron gun having resistors for producing necessary focus voltages without reducing the spacing between the bead glass 23A and the inner wall of the neck portion and also without decreasing the strength and the rigidity of the beaded electrode assembly; thereby it is made possible to obtain a color cathode ray tube which provides good resolution over the entire screen.

Figure 3A:
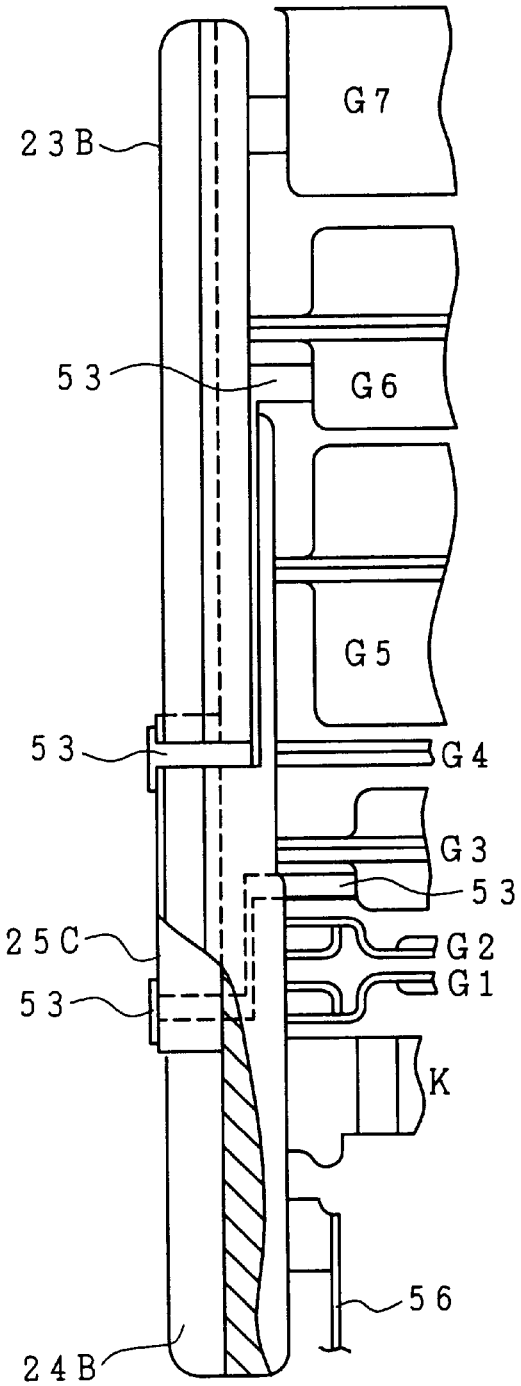
FIGS. 3A and 3B show the primary part of an electron gun for explaining a third embodiment of a color cathode ray tube according to the present invention, and FIG. 3A showing a partially cut-away side view thereof and FIG. 3B showing a front view thereof.
Figure 3B:
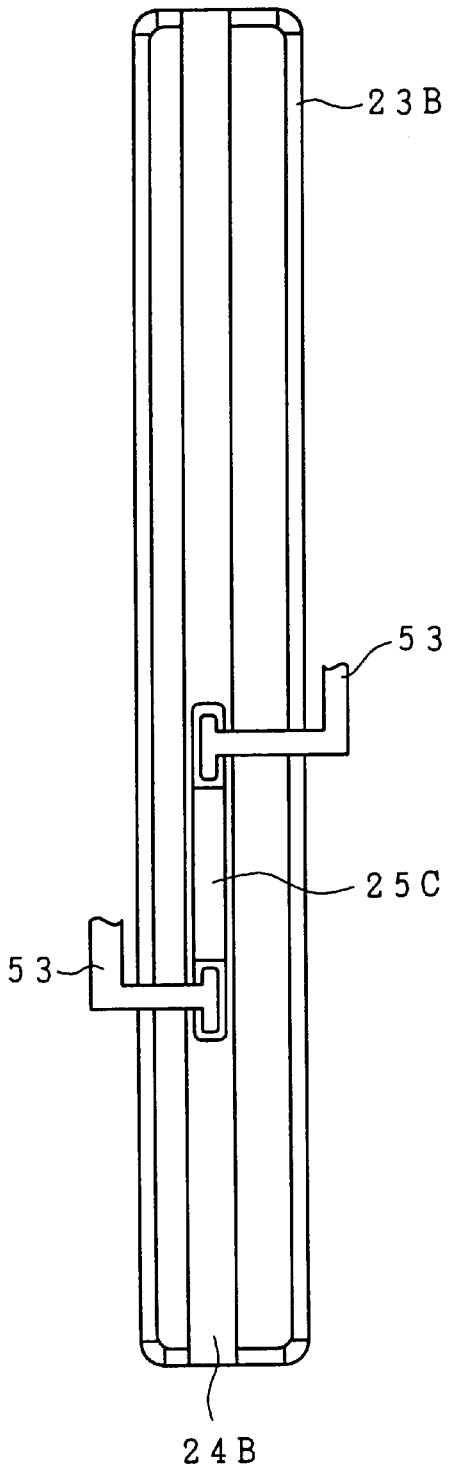

FIGS. 3A and 3B show a primary part of an electron gun for explaining a third embodiment of a cathode ray tube according to the present invention, and FIG. 3A shows a partially cut-away side view of the beaded electrode assembly, and FIG. 3B shows a front view of it. The same reference numerals as utilized in FIGS. 1A and 1B designate corresponding portions in FIGS. 3A and 3B.

In the present embodiment, the cathode K, the first grid electrode G1, the second grid electrode G2, the third grid electrode G3, the fourth grid electrode G4, the fifth grid electrode G5, the sixth grid electrode G6 and the seventh grid electrode G7 are fixed in the predetermined order by embedding peripheral flanges of the grid electrodes or support tabs attached thereto in a pair of the bead glass 23B.

Figure 7B:
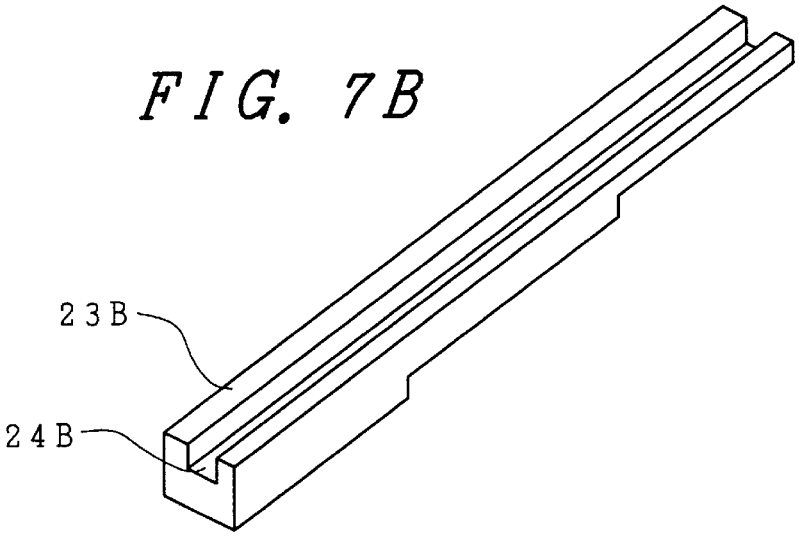

The perspective view of the bead glass 23B is shown in FIG. 7B. The thickness and the shape are, as in the case shown in FIGS. 1A and 1B, approximately same as those of a conventional bead glass (refer to the bead glass shown in FIGS. 11A and 11B). Necessary spacing between the bead glass 23B and the inner wall of the neck portion 2 (refer to FIG. 8) is secured.

A groove-like recess 24B is formed in the back of the bead glass 23B extending in the axial direction in which a resistor element 25C is fitted.

Figure 6C:
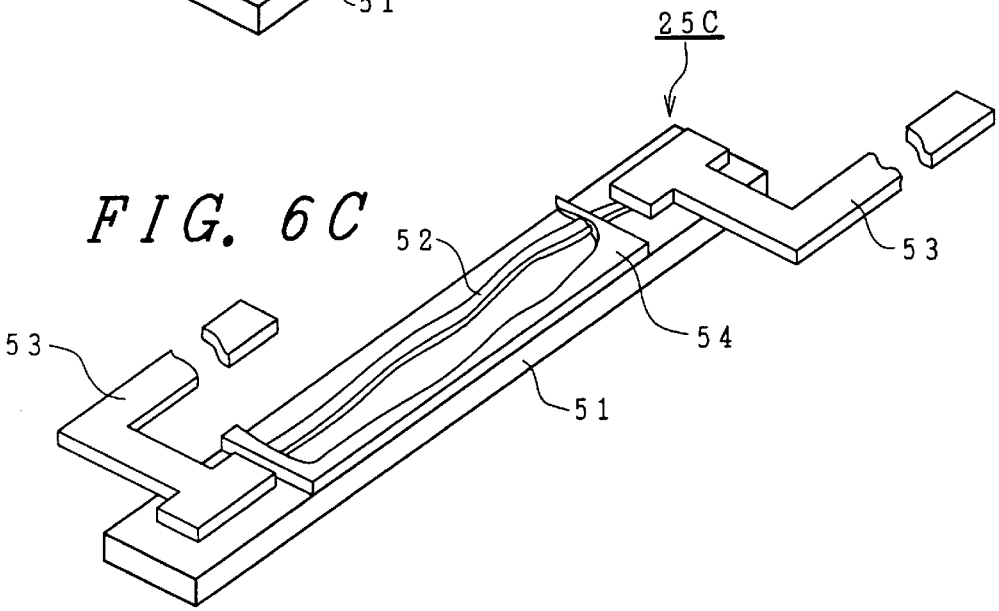

FIG. 6C shows a perspective view of the resistor element 25C, and a resistive film 52 of, for example, ruthenium oxide is coated on an insulating substrate 51 made of ceramic or the like. Connecting tabs 53 are fixed at both ends of the resistive film 52. The resistive film 52 is overcoated with a glass layer 54.

The resistive element 25C is fixed in the recess 24B by fitting snugly. The resistive element 25C can be held in place by press-fitting or friction clamping; and it is also good to fix it with a proper (free from outgassing) adhesive applied onto the bottom surface of it.

In FIG. 3A, however, the resistor element 25C is connected electrically to the grid electrodes and also is fixed physically to the grid electrodes, only by welding one of the connecting tabs 53 of the resistor element 25C to the sixth grid electrode G6 and the other to the third grid electrode G3.

According to the present embodiment, it is possible to obtain an electron gun having resistors for producing necessary focus voltages without reducing the spacing between the bead glass 23B and the inner wall of the neck portion and also without decreasing the strength and the rigidity of the beaded electrode assembly, and it is also possible to obtain a color cathode ray tube which provides good resolution over the entire screen.

Figure 4A:
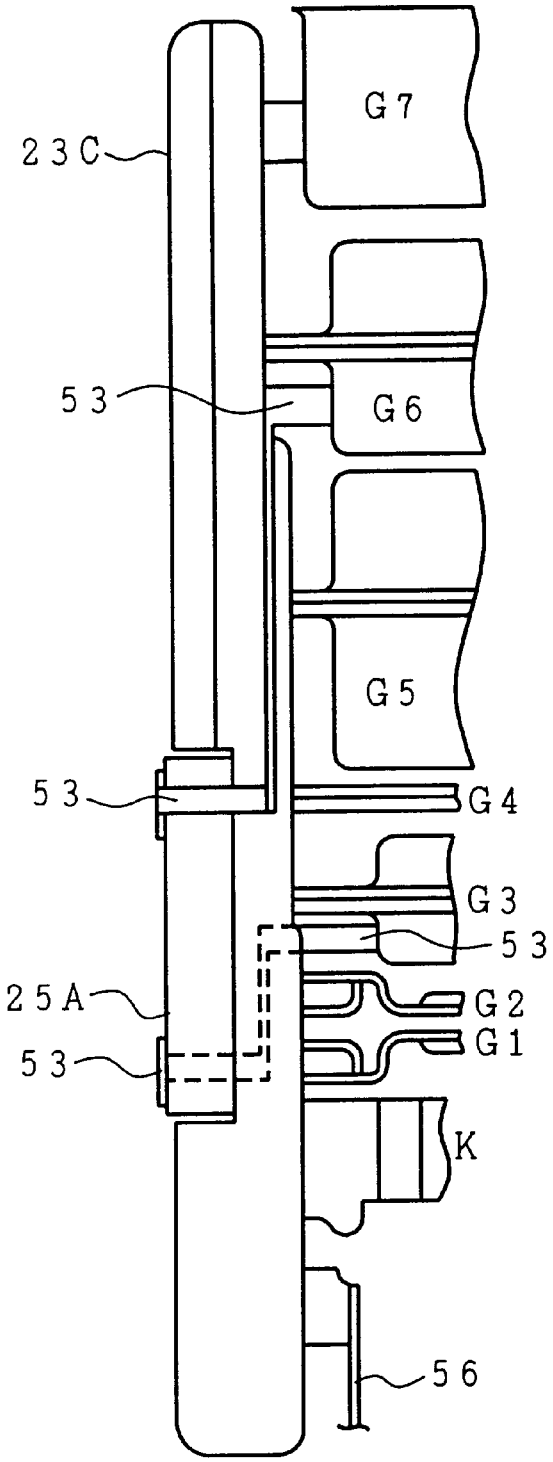
FIGS. 4A and 4B show the primary part of an electron gun for explaining a fourth embodiment of a color cathode ray tube according to the present invention, and FIG. 4A showing a side view thereof and FIG. 4B showing a front view thereof.
Figure 4B:
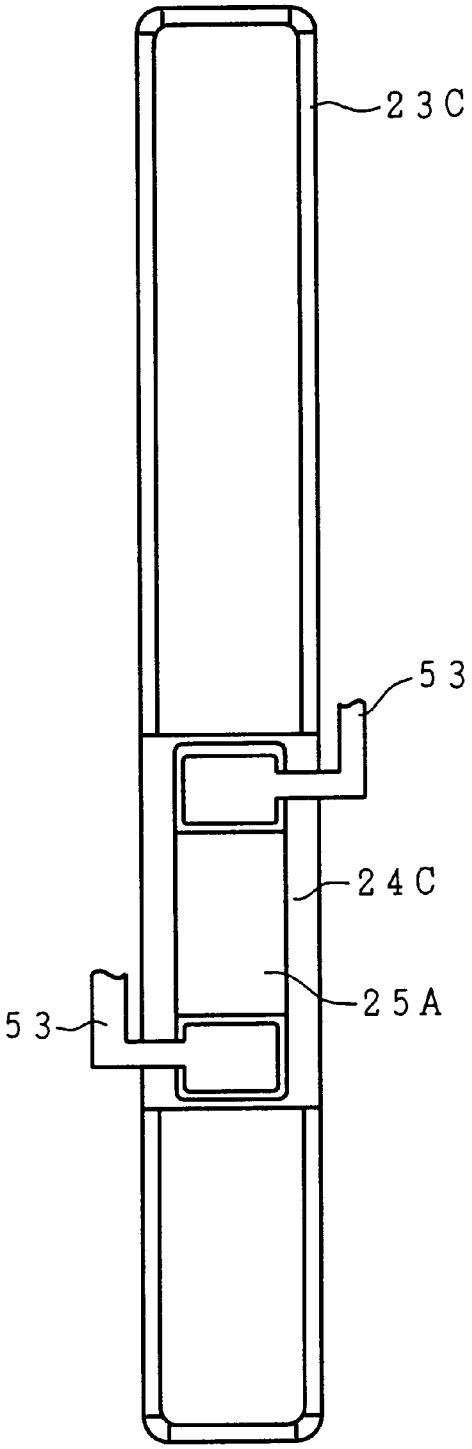

FIGS. 4A and 4B show a primary part of an electron gun for explaining a fourth embodiment of a color cathode ray tube according to the present invention, and FIG. 4A shows a side view thereof, and FIG. 4B shows a front view thereof. The same reference numerals as utilized in FIGS. 1A and 1B designate corresponding portions in FIGS. 4A and 4B.

In the present embodiment, the cathode K, the first grid electrode G1, the second grid electrode G2, the third grid electrode G3, the fourth grid electrode G4, the fifth grid electrode G5, the sixth grid electrode G6 and the seventh grid electrode G7 are fixed in the predetermined order by embedding the peripheral flanges of the grid electrodes or support tabs attached thereto in a pair of bead glass 23C.

Figure 7C:
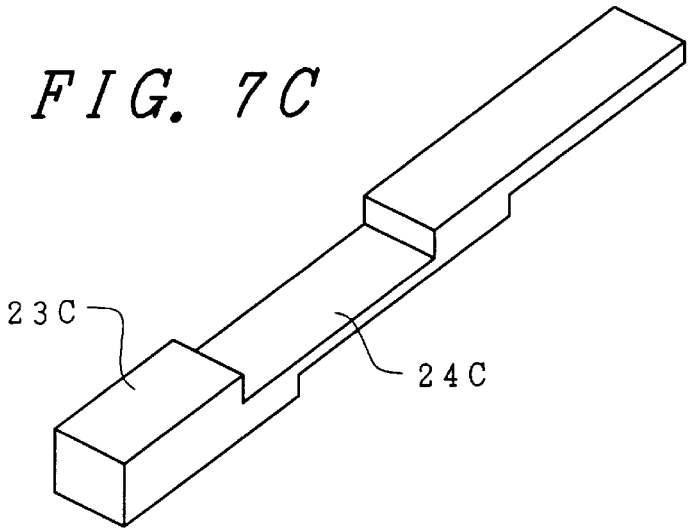

FIG. 7C shows a perspective view of the bead glass 23C. The thickness and the shape of the bead glass 23C are approximately equal to those of the conventional bead glass (refer to the bead glass shown in FIGS. 11A and 11B), and the necessary spacing between the bead glass 23C and the inner wall of the neck portion 2 is secured.

The recess 24C is formed in a part of the back of the bead glass 23C in the form of a thinned-down area, and the resistor element 25A shown in FIG. 6A is mounted in the recess 24C. The resistor element 25A is fitted and fixed in the recess 24C. The resistor element 25A can also be fixed with a proper (free from outgassing) adhesive applied on the bottom surface of the resistor element 25.

In FIG. 4A, however, the resistor element 25A is connected electrically to the grid electrodes and also is fixed physically to the grid electrodes, only by welding one of the connecting tabs 53 of the resistor element 25A to the sixth grid electrode G6 and the other to the third grid electrode G3.

According to the present embodiment, it is possible to obtain an electron gun having resistors for producing necessary focus voltages without reducing the spacing between the bead glass 23C and the inner wall of the neck portion, and also without decreasing the strength and the rigidity of the beaded electrode assembly, and it is also possible to obtain a color cathode ray tube which provides good resolution over the entire phosphor screen.

Figure 5A:
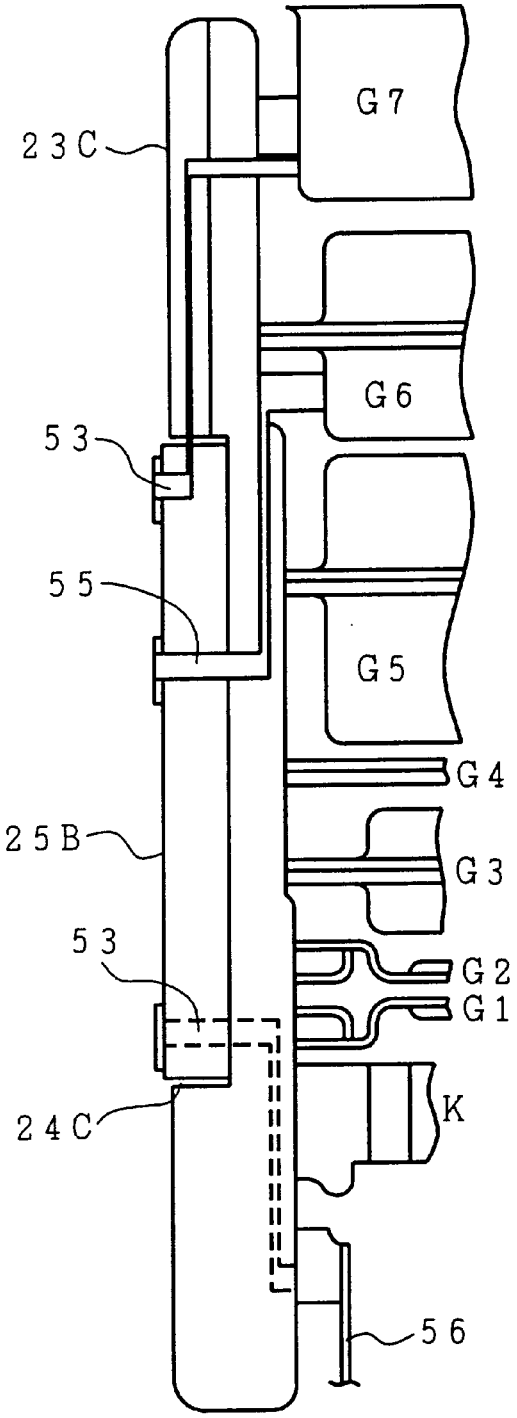
FIGS. 5A and 5B show the primary part of an electron gun for explaining a fifth embodiment of a color cathode ray tube according to the present invention, and FIG. 5A showing a side view thereof and FIG. 5B showing a front view thereof.
Figure 5B:
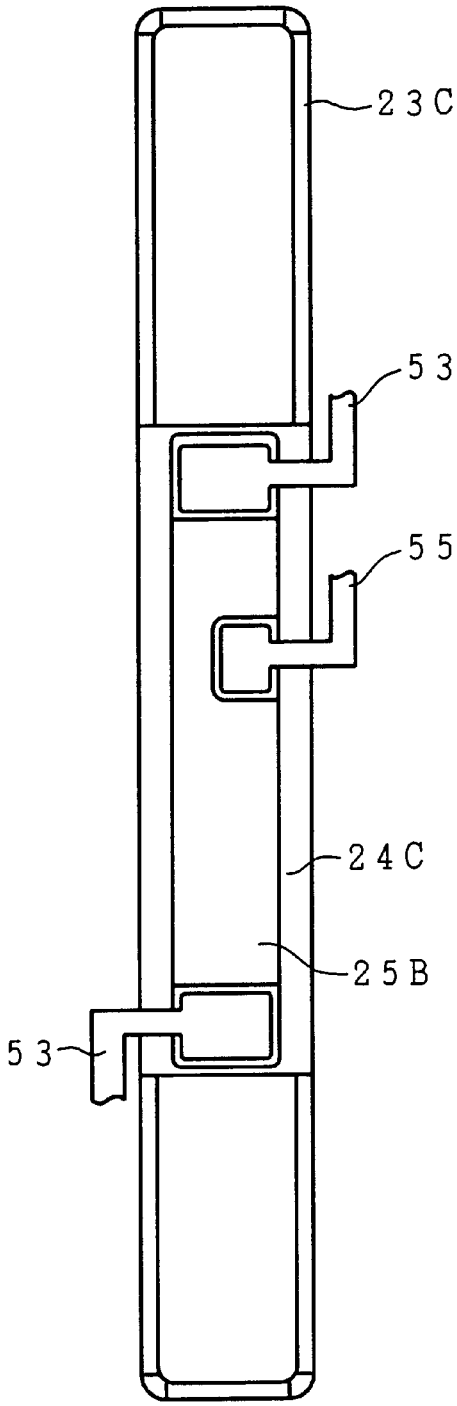

FIGS. 5A and 5B show a primary part of an electron gun for explaining a fifth embodiment of a color cathode ray tube according to the present invention, and FIG. 5A shows a side view of a beaded electrode assembly, and FIG. 5B shows a front view thereof. The same reference numerals as utilized in FIGS. 1A and 1B designate corresponding portions in FIGS. 5A and 5B.

In the present embodiment, the cathode K, the first grid electrode G1, the second grid electrode G2, the third grid electrode G3, the fourth grid electrode G4, the fifth grid electrode G5, the sixth grid electrode G6 and the seventh grid electrode G7 are fixed in the predetermined order by embedding peripheral flanges of the grid electrodes or support tabs attached thereto in a pair of bead glass 23C shown in FIG. 7C.

In a recess 24C formed in the back of the bead glass 23C, a resistor element 25B shown in FIG. 6B is mounted. The resistor element 25B can be also fixed with a proper (free from outgassing) adhesive applied onto the bottom surface of the resistor element 25B.

In FIG. 5A, however, the resistor element 25B is connected electrically to the grid electrodes and also is fixed physically to the grid electrodes, only by welding one of the connecting tabs 53 to the seventh grid electrode G7, the other to the connector 56 which supports the beaded electrode assembly, and the tap 55 to the sixth grid electrode G6. The connector 56 is connected to the stem pin 15 (refer to FIG. 8).

According to the present embodiment, it is possible to obtain an electron gun having resistors for producing necessary focus voltages without reducing the spacing between the bead glass 23C and the inner wall of the neck portion and also without decreasing the strength and the rigidity of the beaded electrode assembly, and also it is possible to obtain a color cathode ray tube which provides good resolution over the entire phosphor screen.

A plurality of voltages required for a multistage focus lens can be produced inside an evacuated envelope by fixing necessary resistor elements in a recess at one or more places. These voltages are not limited to focus voltages, but they can also be voltages for other objects in the evacuated envelope.

As explained in the above, according to the present invention, necessary resistor elements can be mounted for producing the necessary number of focus voltages inside the evacuated envelope without decreasing the thickness of the bead glass, and also the strength and the rigidity of the beaded electrode assembly can be sufficiently secured without reducing the spacing between the resistor elements and the inner wall of the neck portion.

What is claimed is:

1. A color cathode ray tube comprising an evacuated envelope comprising a panel portion having a phosphor screen formed on an inner surface thereof, a neck portion, and a funnel portion connecting said panel portion and said neck portion, and an electron gun housed in said neck portion comprising at least one cathode and a plurality of focus grid electrodes including grid electrodes for forming a multistage focus lens for focusing at least one electron beam emitted from said at least one cathode, said at least one cathode and said plurality of focus grid electrodes being fixed in predetermined axially spaced relationship by a pair of bead glass, wherein said electron gun is provided with a voltage divider for producing at least one voltage other than a voltage supplied from outside said evacuated envelope therefrom, said voltage divider being made of at least one resistor and being fabricated as a separate element from said pair of bead glass, and at least one of said pair of bead glass is provided with a recess for receiving said voltage divider in a surface thereof on a side thereof facing away from said at least one cathode and said plurality of focus grid electrodes.

2. A color cathode ray tube according to claim 1, wherein said recess has walls of a contour defining a rectangular slot.

3. A color cathode ray tube according to claim 1, wherein said recess is a groove extending axially.

4. A color cathode ray tube according to claim 1, wherein said recess is in a form of a thinned-down area.

5. A color cathode ray tube according to claim 1, wherein said voltage divider comprises an insulative substrate, a resistive material disposed on said insulative substrate and a glass layer coated on said resistive material.

6. A color cathode ray tube according to claim 5, wherein said recess has walls of a contour defining a rectangular slot.

7. A color cathode ray tube according to claim 5, wherein said recess is a groove extending axially.

8. A color cathode ray tube according to claim 5, wherein said recess is in a form of a thinned-down area.

* * * * *